US008544690B2

(12) United States Patent
Garcia et al.

(10) Patent No.: US 8,544,690 B2
(45) Date of Patent: Oct. 1, 2013

(54) FLUID PRODUCT DISPENSER

(75) Inventors: Firmin Garcia, Evreux (FR); Gérard Cornet, Blaru (FR)

(73) Assignee: Aptar France SAS, Le Neubourg (FR)

( * ) Notice: Subject to any disclaimer, the term of this patent is extended or adjusted under 35 U.S.C. 154(b) by 1452 days.

(21) Appl. No.: 11/793,293

(22) PCT Filed: Dec. 19, 2005

(86) PCT No.: PCT/FR2005/051102

§ 371 (c)(1),
(2), (4) Date: Jun. 15, 2007

(87) PCT Pub. No.: WO2006/070148

PCT Pub. Date: Jul. 6, 2006

(65) Prior Publication Data

US 2008/0164286 A1 Jul. 10, 2008

(30) Foreign Application Priority Data

Dec. 23, 2004 (FR) ..... 04 53173

(51) Int. Cl.
*B65D 47/02* (2006.01)

(52) U.S. Cl.
USPC ..... 222/147; 222/153.09; 222/321.1

(58) Field of Classification Search
USPC ..... 222/321.1, 23, 147, 153.09; 215/258; 220/214
See application file for complete search history.

(56) References Cited

U.S. PATENT DOCUMENTS

| | | | | |
|---|---|---|---|---|
| 599,156 | A * | 2/1898 | Thompson | 215/258 |
| 2,101,471 | A * | 12/1937 | Greenbaum | 222/147 |
| 3,129,854 | A * | 4/1964 | Boehm et al. | 222/321.9 |
| 4,386,696 | A * | 6/1983 | Goncalves | 215/258 |
| 5,277,340 | A * | 1/1994 | Van Brocklin | 222/321.7 |
| 5,586,589 | A * | 12/1996 | Voelker | 222/147 |
| 6,189,741 | B1 | 2/2001 | Behar | |
| 6,290,100 | B1 * | 9/2001 | Yacko et al. | 222/129 |
| 2003/0109068 | A1 * | 6/2003 | Garcia et al. | 438/1 |
| 2007/0175924 | A1 * | 8/2007 | Lompech et al. | 222/321.1 |

FOREIGN PATENT DOCUMENTS

FR 2 756 546 A 6/1998

* cited by examiner

*Primary Examiner* — Kevin P Shaver
*Assistant Examiner* — Daniel R Shearer
(74) *Attorney, Agent, or Firm* — Sughrue Mion, PLLC

(57) ABSTRACT

A fluid dispenser having a fluid reservoir (2) for containing fluid, the reservoir including an opening (230) having an outer top edge (25) and an inner bottom edge (26); a dispenser member (3), such as a pump or a valve; a fastener that fastens the dispenser member in the opening (230). The dispenser includes a tamperproofing mechanism (1) that is distinct from the fastener and that is secured to the dispenser member (3). The tamperproofing mechanism comes into contact with the inner edge (26) in the event of an attempt at removing the dispenser member (3) from the opening (230).

14 Claims, 4 Drawing Sheets

FLUID PRODUCT DISPENSER

FIELD OF INVENTION

The present invention relates to a fluid dispenser comprising a fluid reservoir for containing fluid, and a dispenser member, such as a pump or a valve. The reservoir includes an opening, generally in the form of a neck, that defines an outer top edge and an inner bottom edge. The pump or the valve is fastened in the opening and generally bears against the outer top edge possibly via a neck gasket. The pump or the valve is of the type that is actuated manually, e.g. by means of a finger. Such dispensers are frequently used in the fields of perfumery, cosmetics, or even pharmacy for dispensing various fluids of various consistencies.

BACKGROUND

Piracy of such dispensers is a major problem, in particular in the field of perfumery. In addition to pure and simple piracy, tampering is another way of infringing the rights of the manufacture or of the initial creator. One type of tampering that is now common consists in removing the dispenser so as to recover either the reservoir and/or the dispenser member, or the fluid, specifically a perfume. Then, the reservoir can be filled with another fluid that does not correspond to the fluid of the reservoir, or similarly the genuine fluid can be packaged in another reservoir possibly with another dispenser member. Either way, it is necessary to remove the dispenser, and in particular to remove the pump or the valve, i.e. to remove the dispenser from the reservoir.

Generally, the pump or valve is fastened on or in a neck, formed by the reservoir, by fastener means, e.g. in the form of a fastener ring.

BRIEF SUMMARY AND EXEMPLARY EMBODIMENTS

An object of the present invention is thus to prevent tampering with such fluid dispensers, or at least to make it more difficult. To this end, an object of the invention is to destroy or to make unusable the fluid contained in the reservoir in the event of an attempt at removing the pump or the valve from the reservoir, in particular after removing the fastener means. Another object of the invention is to make the pump or the valve impossible to remove or at least very difficult to remove, even after the fastener means have been removed or destroyed.

To achieve these objects, the present invention provides tamperproofing means that are distinct from the fastener means and that are secured to the dispenser member, the tamperproofing means coming into contact with the inner edge in the event of an attempt at removing the dispenser member from the opening. The reservoir advantageously includes a neck that projects from a shoulder, the neck defining the opening with its inner edge formed at the junction of the neck and of the shoulder inside the reservoir, the inner edge presenting a diameter that is greater than the diameter of the opening, the neck defining an inside wall connecting both edges together. The tamperproofing means advantageously comprise abutment means that are suitable for coming into abutment contact against the inner edge, said abutment means being deployable between an insertion position in which they are insertable through the opening and a deployed position in which they extend inside the reservoir below the inner edge, in such a manner as to be capable of coming into contact with said inner edge in the event of an attempt at removing the dispenser member from the opening. In the deployed position, the abutment means are not necessarily in contact with the inner edge. They can remain at a distance therefrom, defining an outside diameter that is greater than the diameter of the opening.

A principle of the present invention is to use the engagement of the abutment means against the inner edge of the reservoir to generate or to create one or more reactions that make it more difficult to tamper with the dispenser. The abutment means can come into bearing contact against the inner edge, in particular when the fastener means have already been removed.

In an embodiment, the abutment means are elastically deformable in such a manner as to return to a rest position that corresponds to the deployed position. The abutment means advantageously include an elastically-deformable collar that, in the rest position, points radially outwards towards the inner edge. The elasticity of the collar enables it to pass by elastic deformation through the narrow opening of the reservoir, such that the collar can then be deployed radially outwards once it has passed through the passage of the opening. Naturally, such deployment is accompanied by an increase in the outside diameter of the collar that thus becomes received just below the inner edge, without necessarily being in contact with said inner edge.

In another embodiment, the abutment means comprise an expandable material that is in contact with the fluid. The expandable material can thus be inserted through the opening of the reservoir in its reduced or non-expanded form. In contrast, when it comes into contact with the fluid, a chemical reaction causes the material to expand or dilate in such a manner as to increase its outside diameter beyond the diameter of the opening. Expansion can also be obtained by other means, in particular by radiation.

In another embodiment of the invention, the tamperproofing means include a removable portion that is removed in the event of the bearing contact with the inner edge exceeding a predetermined threshold, such that the removable portion separates from the dispenser member. The removable portion advantageously sinks freely into the reservoir. The separation of the removable portion advantageously releases a substance that is suitable for reacting with the fluid. The separation of the removable portion advantageously reveals a visual indicator. The removable portion may constitute the entire tamperproofing means. The removable portion may even incorporate other elements that provide other functions. However, it is the separation of the removable portion from the dispenser member that constitutes the indicator or trigger means that make it possible to see very quickly that a dispenser has been tampered with.

In another aspect of the invention, the tamperproofing means block the dispenser member in the opening. In this event, the tamperproofing means prevent the dispenser member from being removed or extracted from the opening, but without serving simultaneously to fasten the dispenser member in the opening.

According to another advantageous characteristic of the invention, the tamperproofing means are secured to a support element that is engaged around the dispenser member. The support element is advantageously provided with ID means, advantageously of the radio frequency identification (RFID) type. The tamperproofing means can thus be combined with ID means in the form of a single part that is advantageously engaged or fastened around the dispenser member, or, in a variant, fastened or blocked inside the opening between its top edge and its bottom edge. Another principle of the invention is to provide an internal abutment inside the reservoir that is independent of the assembly or of the fastening of the dispenser member, such that the abutment becomes active when it is desired to remove the dispenser member from the opening. In other words, the dispenser member advantageously does not contribute to providing the abutment below the inner edge of the reservoir. In contrast, when it is desired to remove the dispenser member from the opening, the tamperproofing means come into abutment against the inner edge, thereby either preventing the dispenser member from being removed, or causing some or all of the tamperproofing means to become separated from the dispenser member so as to generate various reactions that make it possible to identify very easily that the dispenser has been tampered with.

BRIEF DESCRIPTION OF THE FIGURES

The invention is described more fully below with reference to the accompanying drawings which show several embodiments of the invention by way of non-limiting example.

In the figures.

DETAILED DESCRIPTION OF CERTAIN EMBODIMENTS OF THE INVENTION

Figure 1:
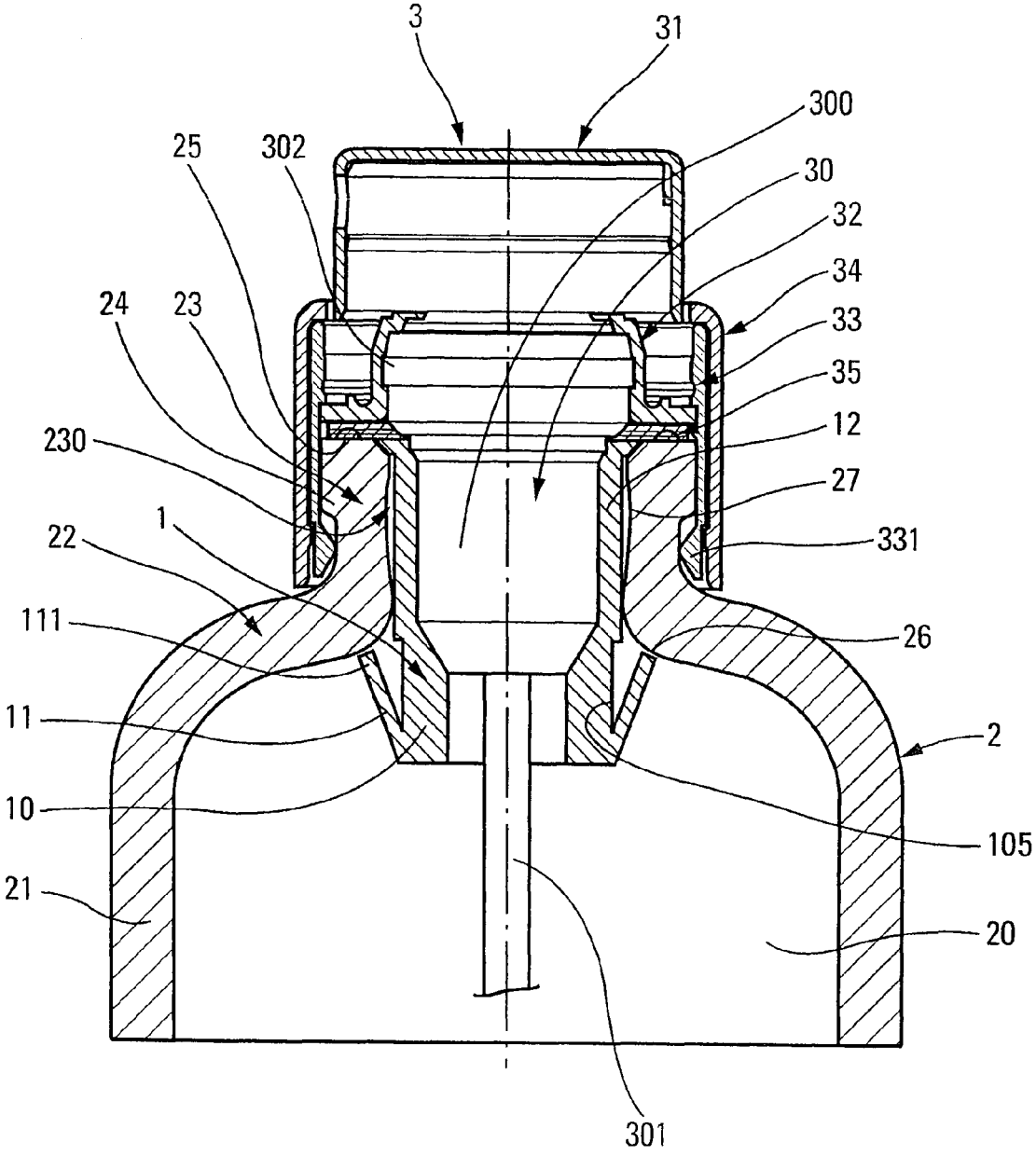
FIG. 1 is a vertical section view through the top portion of a fluid dispenser constituting a first embodiment of the invention.

In the various figures used to illustrate the present invention, the tamperproofing means of the invention have been implemented in a fluid dispenser as is conventionally used in the fields of perfumery, cosmetics, or even pharmacy. In completely conventional manner, a dispenser comprises a reservoir 2 and a dispenser member 3.

The reservoir 2 comprises a reservoir body 21 defining a bottom wall (not shown) and a side wall. At its top end, the body 21 forms a shoulder 22 that is advantageously extended by a projecting neck 23. The neck 23 defines an opening 230 via which the inside of the reservoir can communicate with the outside. The inside of the reservoir defines a working volume 20 for containing fluid. The working volume can be constant or variable, depending on the kind of body 21. The body 21 can be made of a rigid material, resulting in a constant working volume. In a variant, the body 21 can be made of a flexible material in the form of a flexible pouch or of a deformable bottle, and in this event the working volume of the reservoir is variable. In general, regardless of whether the reservoir body 21 is rigid or deformable, the neck 23 is rigid, i.e. made of a non-deformable material. In the embodiment shown in the figures, the reservoir 2 can be made of glass, of rigid or substantially rigid plastics material, or it can even be made of metal. However, other materials are not excluded. The neck 23 comprises a top annular edge 25, an inside wall 27, and an inner bottom edge 26 that is situated substantially at the junction of the neck with the shoulder 22. The inner edge 26 is already situated inside the working volume 20 defined by the reservoir. The inside wall 27 connects the top edge 25 to the inner edge 26. The inside wall 27 presents a shape that is generally cylindrical. The neck 23 also defines outer reinforcement 24 that is in the form of a peripheral flange that projects outwards and that thus defines a step that is directed downwards. This is a completely conventional design for a reservoir for use in the fields of perfumery, cosmetics, or pharmacy.

The dispenser member 3 includes dispenser means 30 that can be in the form of a pump, a valve, or even any stopper system. The dispenser means 30 can be manual, electrical, or electronic. Various technologies can be used such as piezoelectric or ultrasound technologies, for example. In the figures, the dispenser means 30 are shown very diagrammatically, and they can be a manual pump. The pump 30 includes a pump body 300 having a substantially cylindrical or stepped shape. At its top end, the body 300 can form a holding band 302, while at its bottom end, the body 300 can be extended by a dip-tube 301 that extends inside the reservoir 2. Whatever the kind of dispenser means, they must make it possible to take fluid from the reservoir and to dispense the fluid taken so that the user can apply it to an application surface or diffuse it in the air.

The pump 30 is provided with various associated members, such as a pusher 31, for example, that can be pressed by means of one or more fingers so as to actuate the pump 30, and fastener means for fastening the pump 30 on the reservoir. In this embodiment, the fastener means comprise a plurality of parts, namely a ferrule 32, a fastener ring 33, and a covering hoop 34. The band 302 of the pump body 300 is engaged in stationary manner in a housing formed by the ferrule 32. At its outer periphery, the ferrule 32 is engaged inside the ring 33. The ring 33 includes one or more fastener profiles 331 for co-operating with the neck 23 of the reservoir for fastening on the neck of the reservoir. Finally, the hoop 34 comes to block the ring 33 that is engaged around the neck. These are completely conventional fastener means, and other fastener means could be used without going beyond the ambit of the invention. For example, it is possible to use screw-fastener or crimp-fastener means. The purpose of the fastener means is to fasten the dispenser means 30 in secure and leaktight manner on the reservoir. To this end, in order to guarantee sealing at the neck, a neck gasket 35 is provided that is interposed between the ferrule 32 and the top edge 25 of the neck 23. When the dispenser member 3 is mounted on the reservoir as shown in the various figures, the pump body 300 extends inside the neck 23 in the opening 230. The fastener profiles 331 of the ring 33 are engaged below the reinforcement 24 that is formed on the outside of the neck 23. The hoop 34 extends around the ring and advantageously comes to bear against the shoulder 22. The neck gasket 35 is compressed between the ferrule 32 and the top edge 25. The dip-tube 301 extends inside the reservoir into the proximity of its bottom wall. By pressing on the pusher 31, the dispenser means 30 are actuated, thereby dispensing fluid through a dispenser orifice (not shown), but that is very often provided in the pusher 31. This entire mechanism is completely conventional for a fluid dispenser in the fields of perfumery, cosmetics, or pharmacy.

In the invention, the dispenser is provided with tamperproofing or tamper-resistant means that are designated in the figures by the numerical reference 1, even though they are presented in various different embodiments. In addition, in the various embodiments, elements or parts that are identical or that fulfill the same function are designated by the same numerical references, even though they may differ in form.

Reference is made firstly to FIG. 1 in order to describe in detail a first embodiment of tamperproofing means of the invention. The tamperproofing means 1 comprise a body that is generally cylindrical and that defines a bottom portion 10 and a top portion 12. The top portion 12 serves as a fastener bushing for fastening on the body 300 of the dispenser means 30. The bottom portion 10 serves as an extension sleeve and as a base for the abutment means 11, which, in this embodiment, are in the form of a frustoconical collar having a free annular end 111 that points outwards and upwards towards the shoulder 22, and more precisely towards the inner edge 26. In a variant, the collar 11 can be continuous or it can be formed by a plurality of elastically-deformable tabs (or sectors) that are oriented in the same way as the collar. It should be observed that the bottom portion 10 forms a step 105 that is directed inwards relative to the outside wall of the fastener bushing 12. The inwardly-directed step 105 makes it possible to form a free space for the abutment means 11 when they are elastically stressed inwards in such a manner as to press the collar or the tabs against the portion 10. The inwardly-directed step 105 is particularly useful for housing the abutment means 11 therein, when the tamperproofing means 1 are inserted into the reservoir 2 through the opening 230. The opening 230 defines a passage that is narrower than the working volume 20. However, it is still possible to insert the tamperproofing means 1 through the opening 230, since the abutment means 11 can be elastically deformed inwards into the step 105. When the tamperproofing means reach the final position as shown in FIG. 1, the abutment means 11 can once again return to their initial rest position in which their free end points towards the inner edge 26. The free end 111 does not necessarily have to be in contact with the edge 26. A small gap can remain between the end 111 and the edge 26.

The tamperproofing means 1 can be held on the pump body 300 using various techniques, such as adhesive, heat-sealing, or force-fitting. The tamperproofing means 1 can be fastened on the pump body 300 in permanent or removable manner. In other words, it is possible to secure the tamperproofing means 1 and dispenser means 30 in such a manner as to form a single, non-removable part. In a variant, it is possible to separate the tamperproofing means 1, or at least a portion thereof, from the dispenser means 30.

When a tamperer seeks to remove the dispenser, the tamperer generally begins by removing the hoop 34 so as to access the ring 33. On removing the ring, the dispenser means (pump or valve) are also removed. This causes the dispenser means 30 to be displaced inside the neck 23 of the reservoir. Thus, it can easily be understood that a small displacement upwards of the dispenser means causes the free end 111 of the abutment means 11 to bear against the inner edge 26 of the reservoir. If the tamperproofing means 1 are connected permanently to the dispenser means 30, the abutment of the abutment means against the edge 26 prevents the dispenser means 30 from being extracted or removed from the neck 23. In a variant, when the tamperproofing means, or a portion thereof, can be separated from the dispenser means 30, extracting the dispenser means would cause the tamperproofing means, or a portion thereof, to become separated, such that the tamperproofing means, or a portion thereof, remains either in place in the neck 23, or else sinks freely into the reservoir. Even in the event of the collar being deformed substantially, which can lead to the collar turning inside out so that its free end faces downwards, the collar still continues to fulfill its role as abutment means, preventing the tamperproofing means from being extracted from the reservoir. In any event, because of their abutment means, the tamperproofing means 1 cannot be extracted from the reservoir. In the FIG. 1 embodiment, the tamperproofing means are made as a single part with the top portion 12 that is connected integrally with the bottom portion 10. The tamperproofing means 1 are either fastened permanently to the body 300 of the pump 30, or they can be separated completely from the pump body 300. In the event of separation, the tamperproofing means 1 sink freely into the reservoir, thereby making it unfit for subsequent use. By their presence, the abutment means prevent or at least make it difficult for the tamperproofing means to be extracted from the reservoir through the neck. The tamperproofing means moving freely in the reservoir constitute a clear visual indication that the dispenser has been forced.

Figure 2:
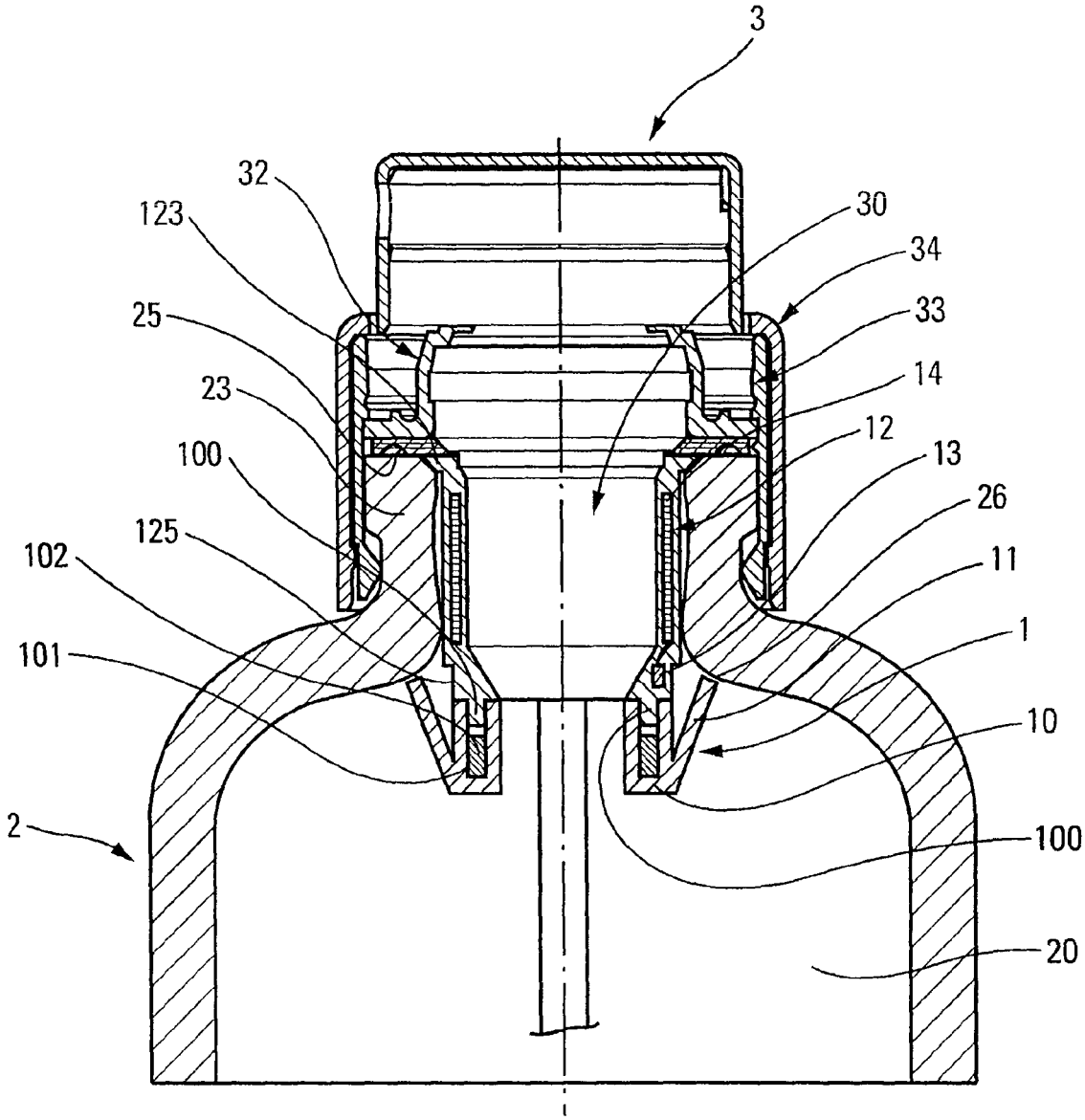
FIG. 2 is a view similar to FIG. 1 for a second embodiment.

The FIG. 2 tamperproofing means constitute a second embodiment of the invention that can be considered as a variant. The tamperproofing means 1 likewise comprise a top portion 12 that forms a fastener bushing for fastening on the body of the dispenser means 30, and a bottom portion 10 that serves as a base for the abutment means 11 for coming into abutment against the inner edge 26 in the event of an attempt at extracting the dispenser means 30. The abutment means 11 are made in identical or similar manner to the FIG. 1 abutment means, i.e. with a peripheral collar or tabs that point outwards and upwards towards the edge 26. The free ends of the abutment means can be spaced apart from the edge 26 by a small gap. However, the ends of the abutment means could alternatively come into contact with the edge 26. In this second embodiment, the bottom portion 10 can be separated from the top portion 12 that is fastened permanently to the body of the dispenser means 30 and/or to the neck 23. In particular, in FIG. 2, it should be observed that the top portion 12 is tightly in contact around the body of the dispenser means 30: fastening can be achieved using any technique, such as heat-sealing, adhesive, or force-fitting, for example. Furthermore, the top portion 12 includes a bearing rim 123 that bears against the neck 23 in the proximity of its top edge 25. More precisely, the neck forms a beveled inlet that extends in annular manner over the inner periphery of the top edge 25. In this embodiment, it is quite possible that the top portion 12 is not fastened permanently to the body of the dispenser means 30, and that the top portion 12 is held in place merely by the bearing rim 123. Still in this embodiment, the top portion 12 serves as a support element for an ID unit that comprises an electronic chip 13 and an antenna 12 that is coiled around the body of the dispenser means, for example. By way of example, the ID means can use RFID technology The ID unit can remotely deliver data relating to the dispenser. The chip 13 makes it possible to store data, whereas the antenna 12 serves to receive and to transmit signals that also power the ID unit.

As mentioned above, the portion 12 can be separated from the portion 10 at a junction that can be achieved by snap-fastening or by force-fitting. The top portion 12 can form snap-fastener means 100, in the form of a cylinder or discontinuous lugs, that are engaged in a housing 101 in non-permanent or removable manner. In a variant, the junction can be achieved in the form of a breakable material bridge or of weak heat-sealing, for example. The housing 101, that serves as a snap-fastener or force-fit housing, also contains a substance 102 that is suitable for reacting with the fluid stored inside the reservoir, for example. It is also possible to envisage a substance 102 that reacts with radiation of any kind, such as daylight. The housing 101 opens upwards, and after the portion 10 has been separated from the portion 12, the housing is accessible and the substance 102 can thus enter into contact with the fluid. Just as in the above-described embodiment, the bottom portion 10 serves as a base for the abutment means 11 that point towards the edge 26. In this embodiment, the snap-fastener means 100 (and more generally the junction between the portions 10 and 12) serve as closure means for closing the housing 101 that contains the substance 102. The tamperproofing means also form a peripheral recess for housing the abutment means 11 during passage through the neck 23. The recess advantageously extends over both the top portion and the bottom portion 10. On the top portion 12, the recess can be provided with a warning or with an indicator 125 that is visible once the portion 10 has become separated from the portion 12. When a tamperer seeks to remove the dispenser means 30, the tamperer exerts upward traction, thereby bringing the free end of the abutment means 11 into bearing contact against the edge 26. By exerting a force that is greater than a predetermined threshold, the portion 10 becomes separated from the portion 12 and sinks freely inside the reservoir. On becoming separated, the abutment means 11 reveal or uncover the bottom of the portion 12, more particularly at the recess, such that the warning or the indicator 125 is thus visible through the reservoir when said reservoir is transparent. Thus, even in the event of a mere attempt at extracting the dispenser means, the bottom portion 10 becomes separated from the top portion 12 and sinks inside the reservoir. The reactive material 102 thus "pollutes" the fluid, denaturing it in various ways. For example, it is possible to envisage that the material 102 colors the fluid, modifies its odor, changes its viscosity, etc. In any event, it is necessary for the portion 12 to be secured to the dispenser means 30, since it serves as an element for transmitting traction to the bottom portion 10.

Figure 3B:
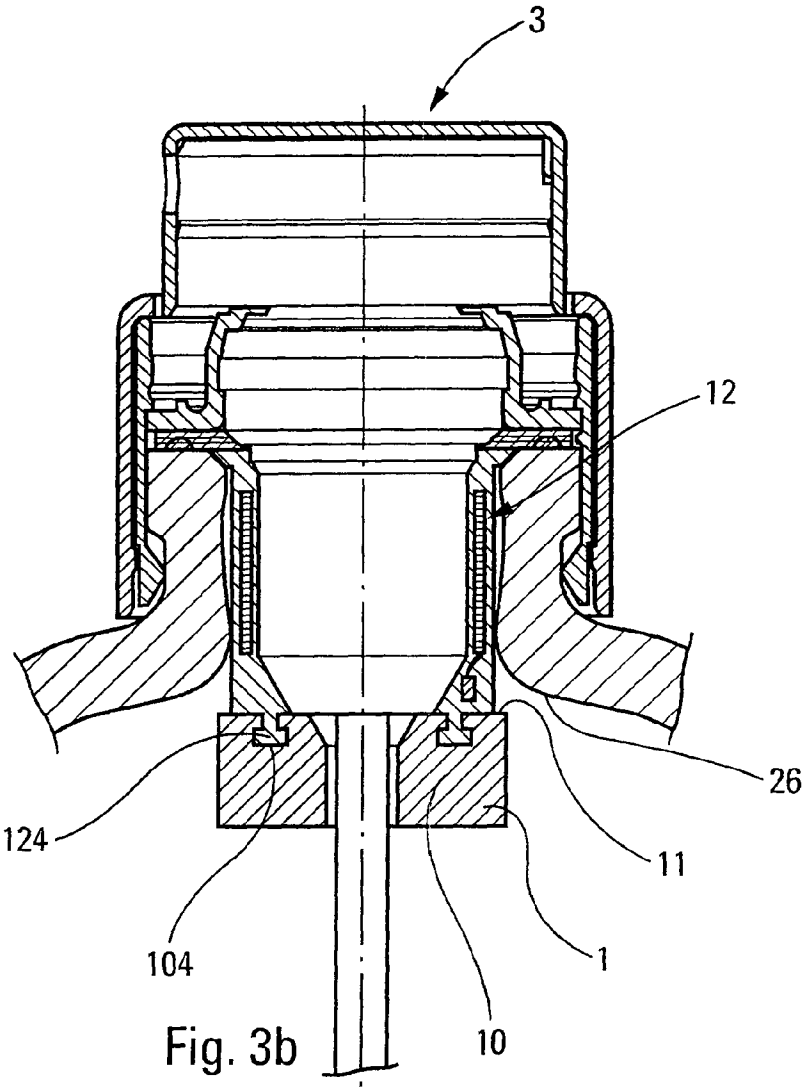
FIGS. 3*a* and 3*b* are views similar to FIGS. 1 and 2 for a third embodiment, respectively in the initial position and in the expanded position after reaction.
Figure 3A:
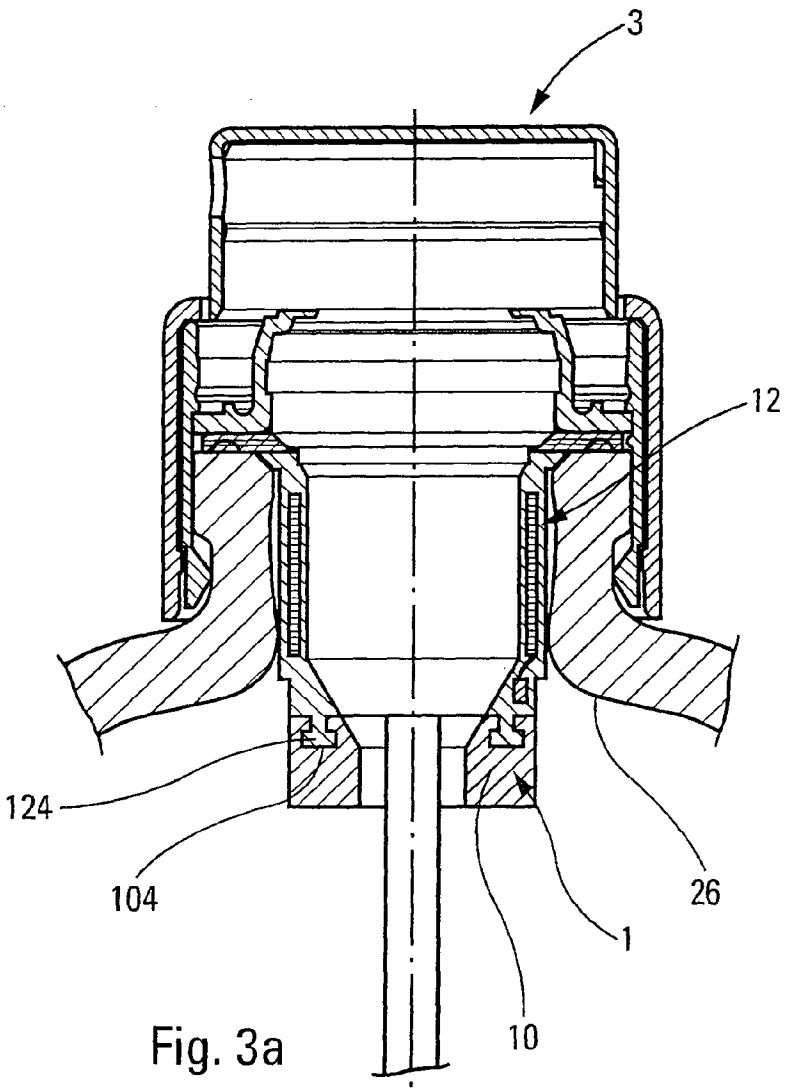

Reference is made below to FIGS. 3*a* and 3*b* that show a third embodiment in which the tamperproofing means 1 likewise comprise a top portion 12 that serves as a fastener bushing for fastening to the pump body, and a bottom portion 10 that comes into abutment against the edge 26 in the event of an attempt at extracting the dispenser means from the reservoir or in the event of the dispenser means being successfully extracted therefrom. In this embodiment, the top portion 12 is likewise provided with an ID unit that can be identical to the ID unit in FIG. 2. The top portion 12 is fastened permanently to the body of the dispenser means using any appropriate technique. The top portion 12 can likewise form a bearing rim that is identical to the bearing rim in FIG. 2. However, this characteristic is optional. In the invention, the top portion 12 is provided with anchor means 124 that can be in the form of a continuous annular bead or in the form of discontinuous lugs that are distributed in peripheral manner. The anchor means 124 are situated at the bottom end of the top portion 12. In this embodiment, the bottom portion 10 is made of an expandable material that is overmolded on the anchor means 124, for example. In the initial state, the bottom portion 10 presents an outside diameter that is substantially equal to the diameter of the top portion 12, such that the tamperproofing means can be inserted through the opening of the reservoir without any friction or without excessive friction. In the invention, the material constituting the bottom portion 10 is suitable for reacting with the fluid that is situated in the reservoir in such a manner as to expand, thereby increasing its outside diameter, as can be seen in FIG. 3*b*. It is also possible to provide a material that reacts with radiation or with heat. In any event, the expansion of the bottom portion 10 increases its size, and thus creates an abutment profile 11 that is situated in the proximity of the inner edge 26. The profile 11 serves as abutment means in the same way as the collar or the tabs of the first and second embodiments. When a tamperer seeks to remove the dispenser means, the abutment profile 11 comes into bearing contact against the edge 26. Two situations are thus possible. Firstly, the bottom portion 10 is connected in secure manner to the top portion 12, and in this event it is not possible to remove the dispenser means. Secondly, the bottom portion 10 becomes separated from the top portion 12 by rupturing the anchor means 124, and in this event it is possible to remove the dispenser means, but the bottom portion 10 then sinks freely inside the reservoir. Once again, the tamperproofing means include abutment means that are suitable for coming into abutment contact against the inner edge 26 of the neck of the reservoir.

Figure 4:
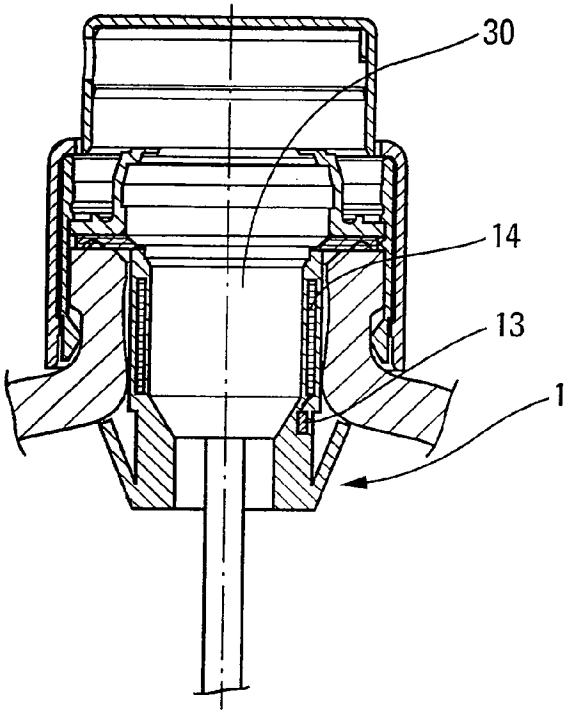

Reference is made below to FIG. 4 which shows a variant embodiment that can be considered as a hybrid between the first and second embodiments. In this embodiment, the tamperproofing means 1 are made as a single part, i.e. with the top portion being made integrally with the bottom portion. The bottom portion serves as a support for the abutment means that point towards the bottom edge of the neck. The tamperproofing means 1 do not have a bearing rim that is suitable for coming to bear against the neck. The tamperproofing means 1 can be connected permanently to the dispenser means 30, such that they block the dispenser means 30 permanently in the neck. In a variant, the tamperproofing means 1 can be separable from the dispenser means 30, such that an attempt at extracting the dispenser means 30, or successful extraction thereof, separates the tamperproofing means 1 which then sink inside the reservoir.

Figure 5:
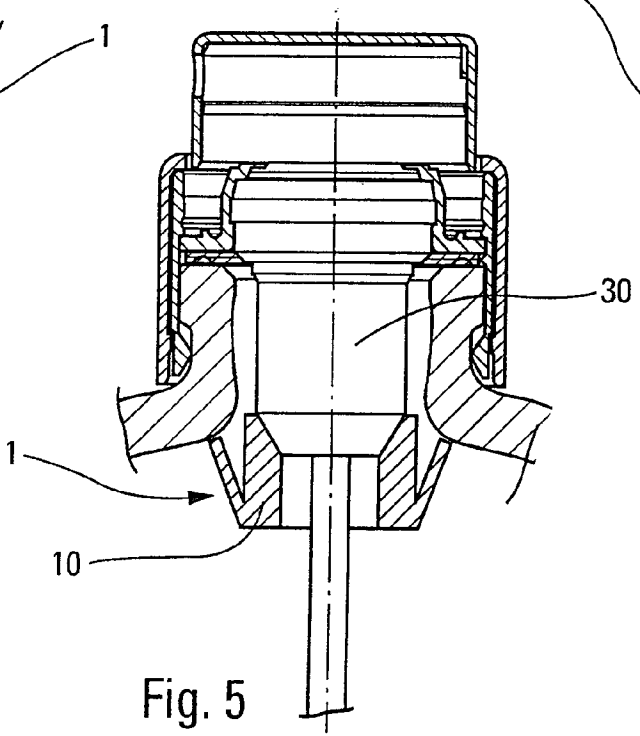

FIG. 5 shows tamperproofing means 1 that do not have a top portion. In this embodiment, the tamperproofing means amount to the bottom portion 10 that is fastened directly to the body of the dispenser means 30 in permanent or removable manner. In a variant, it is possible to envisage making the tamperproofing means integrally with the body of the dispenser means. In the event of an attempt at removal, the body is damaged or even broken into a plurality of fragments.

Figure 6:
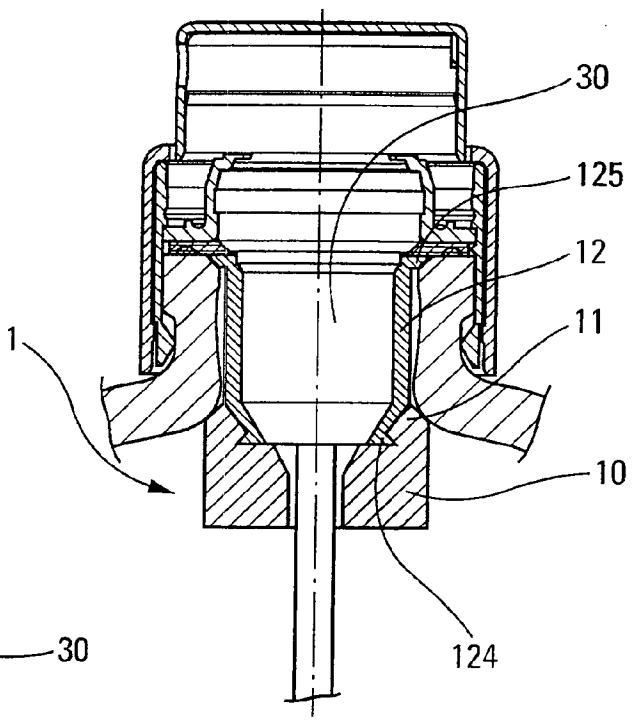
FIGS. 4, 5, and 6 are views similar to the above-mentioned figures for fourth, fifth, and sixth embodiments of the invention.

In the last embodiment in FIG. 6 that constitutes a variant embodiment of the third embodiment in FIGS. 3*a* and 3*b*, the bottom portion 10 of the tamperproofing means 1 are likewise made of an expandable material. However, once expanded, the bottom portion comes into bearing contact against the neck at its bottom edge. This causes the tamperproofing means 1 to be fastened securely inside the neck. This is enhanced by the top portion 12 including a bearing rim 125 that bears against the beveled inlet of the neck. By fastening the tamperproofing means permanently to the dispenser means, the dispenser means 30 can be fastened securely inside the neck merely by the tamperproofing means. In this event, it is possible to eliminate the ferrule, the fastener ring, and the hoop. It is even possible to envisage dispenser means 30, e.g. a pump or a valve, having a body that is provided, at its bottom portion, with a cylinder of expandable material that fastens the pump or the valve permanently in the neck of the reservoir. In this event, the tamperproofing means fulfill a genuine function of fastening the pump in permanent and irremovable manner.

In all of the embodiments, the tamperproofing means can be considered as including abutment means that are suitable for coming into bearing contact against the inner edge of the neck of the reservoir, the abutment means being fastened on a support element that comes into engagement either with the body of the dispenser means, or with the neck, or with both simultaneously. In addition, the support element can be made as a single part or it can be divided into two parts, with one remaining fastened to the body of the dispenser means or to the neck, while the other sinks freely inside the reservoir.

A principle of the invention is to insert an element into the reservoir together with the dispenser member (pump, valve, stopper, etc.), the element no longer being extractable from the reservoir, even in the event of the dispenser member being removed or in the event of an attempt at removal. Naturally, in most events, removal or an attempt at removal can be performed only after already removing or destroying the fastener means that hold the dispenser member firmly on or in the neck of the reservoir, the fastener means generally being distinct from the tamperproofing means.

The invention claimed is:

1. A fluid dispenser comprising:

a fluid reservoir (2) for containing fluid, the reservoir including an opening (230) having an outer top edge (25) and an inner bottom edge (26);

a dispenser member (3);

fastener means for fastening the dispenser member in the opening (230); and tamperproofing means (1) that are distinct from the fastener means and that are secured to the dispenser member (3), the tamperproofing means coming into contact with the inner edge (26) in the event of an attempt at removing the dispenser member (3) from the opening (230), wherein the tamperproofing means are secured to a support element (12) that is engaged around the dispenser member (3) and that is provided with ID means (13, 14); and the tamperproofing means comprising abutment means (11) that are suitable for coming into abutment contact against the inner edge (26), said abutment means deployable between an insertion position in which the abutment means are insertable through the opening (230) and a deployed position in which the abutment means extend inside the reservoir below the inner edge (26), in such a manner as to be capable of coming into contact with said inner edge in order to prevent removal of the dispenser member.

2. A fluid dispenser according to claim 1, in which the reservoir (2) includes a neck (23) that projects from a shoulder (22), the neck (23) defining the opening (230) with its inner edge (26) formed at the junction of the neck (23) and of the shoulder (22) inside the reservoir, the inner edge (26) presenting a diameter that is greater than the diameter of the opening (230), the neck defining an inside wall (27) connecting both edges together.

3. A fluid dispenser according to claim 1, in which the abutment means (11) are elastically deformable in such a manner as to return to a rest position that corresponds to the deployed position.

4. A fluid dispenser according to claim 3, in which the abutment means include an elastically-deformable collar (11) that, in the rest position, points radially outwards towards the inner edge (26).

5. A fluid dispenser according to claim 1, in which the abutment means (11) comprise an expandable material.

6. A fluid dispenser according to claim 1, in which the tamperproofing means (1) block the dispenser member in the opening.

7. A fluid dispenser according to claim 1, in which, in the deployed position, the abutment means (11) are not in contact with the inner edge (26).

8. A fluid dispenser according to claim 1, wherein the ID means remotely delivers data relating to the dispenser.

9. A fluid dispenser according to claim 1, wherein the ID means is of the RFID type.

10. A fluid dispenser comprising:

a fluid reservoir, the reservoir comprising an opening comprising an outer top edge and an inner bottom edge;

a dispenser member;

a fastener that secures the dispenser member in the opening;

a support element engaged around the dispenser member and comprising an identification device;

a tamperproofing mechanism distinct from the fastener and secured to the dispenser member, the tamperproofing mechanism coming into contact with the inner edge in the event of an attempt at removing the dispenser member from the opening, the tamperproofing mechanism secured to the support element that is engaged around the dispenser member and that is provided with the identification device;

the tamperproofing mechanism comprising an abutment portion that abuts the inner edge and that is deployable between an insertion position during which the tamperproofing mechanism is inserted through the opening and a deployed position in which the abutment portion extends inside the reservoir below the inner edge so as to come into contact with the inner edge at least when removal of the dispenser member is attempted so as to prevent removal of the dispenser member.

11. The fluid dispenser according to claim 10, wherein the identification device comprises RFID technology that remotely delivers data relating to the dispenser.

12. The fluid dispenser according to claim 10, wherein the reservoir comprises a neck that projects from a shoulder of the reservoir, the neck defining the opening with its inner edge formed at the junction of the neck and the shoulder inside the reservoir, the inner edge presenting a diameter that is greater than the diameter of the opening, the neck defining an inside wall connecting both edges together.

13. The fluid dispenser according to claim 10, wherein the abutment portion is elastically deformable so as to return to a rest position that corresponds to the deployed position.

14. The fluid dispenser according to claim 13, wherein the abutment portion comprises an elastically-deformable collar that, in the rest position, extends radially outwards towards the inner edge.

* * * * *